US008967499B2

(12) United States Patent
Lee

(10) Patent No.: US 8,967,499 B2
(45) Date of Patent: Mar. 3, 2015

(54) WATER SPRAY PLATE AND WATER SAVING SHOWER USING THE SAME

(76) Inventor: Jang Woo Lee, Guri-si (KR)

( * ) Notice: Subject to any disclaimer, the term of this patent is extended or adjusted under 35 U.S.C. 154(b) by 482 days.

(21) Appl. No.: 12/746,592

(22) PCT Filed: Mar. 31, 2009

(86) PCT No.: PCT/KR2009/001643

§ 371 (c)(1),
(2), (4) Date: Jun. 7, 2010

(87) PCT Pub. No.: WO2009/145450

PCT Pub. Date: Dec. 3, 2009

(65) Prior Publication Data

US 2010/0276519 A1 Nov. 4, 2010

(30) Foreign Application Priority Data

Apr. 2, 2008 (KR) ..... 10-2008-0030715
Mar. 23, 2009 (KR) ..... 10-2009-0024487
Mar. 23, 2009 (KR) ..... 10-2009-0024498

(51) Int. Cl.
*B05B 1/34* (2006.01)
*B05B 1/18* (2006.01)
*B05B 1/14* (2006.01)
*B05B 15/00* (2006.01)

(52) U.S. Cl.
CPC . *B05B 1/185* (2013.01); *B05B 1/14* (2013.01); *B05B 15/008* (2013.01)
USPC ..... 239/494; 239/461

(58) Field of Classification Search
CPC ..... B05B 1/02; B05B 1/14
USPC ..... 239/390, 391, 552, 543, 548, 558, 559, 239/496–498
See application file for complete search history.

(56) References Cited

U.S. PATENT DOCUMENTS 3,844,485 A * 10/1974 Waggoner ..... 239/420
4,765,540 A * 8/1988 Yie ..... 239/8
5,297,739 A * 3/1994 Allen ..... 239/530
5,699,964 A 12/1997 Bergmann et al.

(Continued)

FOREIGN PATENT DOCUMENTS

CN 200977488 11/2007
DE 20120575 5/2002

(Continued)

*Primary Examiner* — Melanie Tyson
*Assistant Examiner* — Viet Le
(74) *Attorney, Agent, or Firm* — Sherr & Jiang, PLLC

(57) ABSTRACT

A shower plate and a water-saving shower using the same are disclosed. The shower plate provided in a head body of a shower used to supply fluid along an inner path thereof, the shower plate includes a plurality of spray holes configured to spray the supplying fluid out, wherein a predetermined amount of the spray hole are direction changing spray holes comprising a direction changing parts projected inwardly there from. The water-saving shower includes a shower plate provided in a head body of a shower used to supply fluid along an inner path thereof, the shower plate comprising a plurality of spray holes configured to spray the supplying fluid out, wherein a predetermined amount of the spray hole are direction changing spray holes comprising a direction changing parts projected inwardly there from, and a filter provided in the head body to filter foreign substances contained in the supplying fluid before the supplying fluid reaches the shower plate.

4 Claims, 6 Drawing Sheets

(56) References Cited

U.S. PATENT DOCUMENTS

| | | | | |
|---|---|---|---|---|
| 2002/0070293 | A1 | 6/2002 | Ti | |
| 2006/0208105 | A1* | 9/2006 | Prociw et al. | 239/406 |
| 2007/0069040 | A1* | 3/2007 | Lewis et al. | 239/8 |
| 2007/0246577 | A1* | 10/2007 | Leber | 239/589 |
| 2010/0024910 | A1* | 2/2010 | Nakamori et al. | 138/39 |

FOREIGN PATENT DOCUMENTS

| | | | |
|---|---|---|---|
| JP | 06-121941 | A | 5/1994 |
| JP | 6121941 | | 5/1994 |
| JP | 2001173045 | | 6/2001 |
| KR | 10-2005-0063759 | A | 6/2005 |
| KR | 1020050063759 | | 6/2005 |
| KR | 100867486 | | 10/2008 |
| WO | WO00/30759 | | 6/2000 |
| WO | WO2005/063104 | | 7/2005 |
| WO | WO2007/007984 | | 1/2007 |

* cited by examiner

UPPER SURFACE

SIDE SURFACE

WATER SPRAY PLATE AND WATER SAVING SHOWER USING THE SAME

CROSS REFERENCE TO PRIOR APPLICATIONS

The present application is a National Stage Application of PCT International Application No. PCT/KR2009/001643 (filed on Mar. 31, 2009), under 35 U.S.C. §371, which claims priority to Korean Patent Application Nos. 10-2008-0030715 (filed on Apr. 2, 2008), 10-2009-0024487 (Mar. 23, 2009), and 10-2009-0024498 (filed on Mar. 23, 2009), which are all hereby incorporated by reference in their entirety.

TECHNICAL FIELD

The present invention relates to a shower plate and a water-saving shower using the same, more specifically, to a shower plate which can obliquely spray supplying fluidal material by changing a shape of a spray hole formed therein, and a water-saving shower using the same.

BACKGROUND ART

Generally, showers looking like watering pots are spraying devices which can spray supplying fluidal material such as cold water and hot water, used in a home bathroom, sink and bath tub and in a for-business water pull, water softener and a tub broadly.

Such a shower may be classified into a standing type shower and a sitting type shower and the shape of the shower may be variable according to its type.

The supplying fluidal material such as cold water and hot water supplied via a hose passes a shower head of the shower and it is sprayed into shower objects via a plurality of spray holes formed in a shower plate.

The supplying fluidal material sprayed to the spraying objects typically has a spraying area corresponding to the width of the shower plate.

However, when supplying the supplying fluidal material to the spraying objects via the shower, a conventional shower uses a curvature shower plate or a thick shower plate having oblique spray holes, to diffuse the fluidal material broadly or to focus the fluidal material intensively on a single point.

Recently, a water-saving shower has been introduced to save water and a shower plate having a diameter getting larger from an inner portion to an outer portion of the head is provided in the water-saving shower, such that a water-saving effect may be gained. However, this structure requires an auxiliary part to form an auxiliary small diameter part disadvantageously and the production cost will be increased accordingly.

In addition, to achieve the water-saving effect, the number of the spray holes formed in the shower plate or the size of each spray hole is reduced. However, this structure will fail to enable a proper amount of water to be supplied in case a user uses the shower or the shower timing will be lengthened enough to remove the water-saving effect.

In the meanwhile, the water supplied to an inner path of the shower via a hose may contain foreign substrates and it is necessary to filter and remove the foreign substances.

Non-woven fabric is used to remove the foreign substances contained in the water and the non-woven fabric has to be replaced with new one inconveniently when a lot of foreign substances are accumulating.

Moreover, the non-woven fabric always contains moisture and bad bacteria and mold will breed easily in the wet non-woven fabric. In this case, the non-woven fabric cannot be recycled and it has to be replaced with new one.

DISCLOSURE OF INVENTION

Technical Problem

To solve the problems, an object of the present invention is to provide a thin-plate-shaped shower plate which can determine a spraying shape of supplying fluid sprayed there through based on appearance and arrangement of spray holes formed therein, to enable the supplying fluid diffused broadly or united into a single stream.

Another object of the present invention is to provide a shower plate which can unite the supplying fluid sprayed toward a spraying object with each other.

A further object of the present invention is to provide a water-saving shower including a filter which is reusable by washing, without replaced with a new one, when foreign substances are loaded in a filter in case of unsmooth flow of the supplying fluid caused by foreign substances loaded in a filter.

Technical Solution

To achieve these objects and other advantages and in accordance with the purpose of the invention, as embodied and broadly described herein, a shower plate provided in a head body of a shower used to supply fluid along an inner path thereof, the shower plate includes a plurality of spray holes configured to spray the supplying fluid out, wherein a predetermined amount of the spray hole are direction changing spray holes comprising a direction changing parts projected inwardly there from.

The direction changing spray holes may be located in an outer portion of the shower plate and a spraying scope of the supplying fluid may be determined by outward or inward projection of the direction changing parts with respect to the shower plate.

The direction changing spray hole may be concave-quadrangle-shaped.

A plurality of shower spray groups may be arranged in the shower plate to unite the supplying fluid sprayed out into a single stream, each of the shower spray groups comprising a plurality of direction changing spray holes.

At least one spray hole may be formed in a center of the shower spray group and the plurality of the direction changing spray holes may be surroundingly arranged with the spray hole as their center.

The direction changing parts of the direction changing spray holes may be projected toward the spray hole formed in the center of the shower spray groups.

In another aspect of the present invention, a water-saving shower includes a shower plate provided in a head body of a shower used to supply fluid along an inner path thereof, the shower plate comprising a plurality of spray holes configured to spray the supplying fluid out, wherein a predetermined amount of the spray hole are direction changing spray holes comprising a direction changing parts projected inwardly there from; and a filter provided in the head body to filter foreign substances contained in the supplying fluid before the supplying fluid reaches the shower plate.

The filter may include a filtering net supporter comprising a plurality of openings configured not to interfere with the flow of the supplying fluid supplied along the inner path of the head body; and a filtering net woven with synthetic fabric to filter foreign substances contained in the supplying fluid, the filtering net secured to a rear surface of the filtering net supporter.

The filtering net may be satin-woven.

The filtering net may be heat-stakingly secured to the filtering net.

The water-saving shower may further include a filter housing secured to the filtering net supporter, filled with ceramic balls, the filter housing comprising a plurality of openings formed in front and rear surfaces thereof.

The ceramic ball may be made of one of sulfur balls, tourmaline gemstone, selenium, negative-ion resin, germanium, red clay, elvan, zeolite and sericite or compounds thereof.

Advantageous Effects

The present invention has following advantageous effects.

First of all, a predetermined amount of the spray hole are direction changing spray holes comprising a direction changing parts projected inwardly there from. Without using a curvature shower plate to diffuse supplying fluid sprayed toward a spraying object broadly or to unite supplying fluid into a single point or a shower plate having an enough thickness to form spray holes obliquely, a thin-plate shaped shower plate according to the present invention may be used to implement the above functions and the production cost may be reduced.

Furthermore, plurality of shower spray groups configured to unite the supplying fluid sprayed out into a single stream are arranged. Even with a small amount of supplying fluid, the user may feel that the supplied fluid is enough and the supplying fluid may be saved accordingly.

Still further, the shower spray groups formed to unite the supplying fluid sprayed out into a single stream enables diameters of the spray hole relatively small. As a result, negative-ion generation during the process of spraying the supplying fluid out may be increased.

Still further, as the diameter of the spray hole is getting smaller, the pressure of the water sprayed out may be increased. As a result, even with the identical amount of the water, washing efficiency may be improved advantageously.

Still further, even through the pressure of the supplying fluid supplied to the shower is low, the supplying fluid substantially sprayed out has an increased pressure enough to be sprayed toward the shower object.

Still further, a filter including a filtering net woven with synthetic fabric is provided in a head body of a shower. In case the flow of the supplying fluid is not smooth, a filter loaded with foreign substances may be washed to be reusable, without replaced with a new one.

Still further, different from felt which is non-woven fabric, used in the conventional filter, the filtering net of the filter is woven with synthetic fabric to prevent the supplying fluid from being absorbed thereto. As a result, there may be little concern of bacteria and mold breeding and there may be a sanitary advantageous effect.

Still further, the filtering net is satin-woven with synthetic fabric and a surface of the filtering net is smooth and dense enough to be washed conveniently and to improve efficiency of foreign substance removal.

Lastly, the filter is filled with ceramic balls capable implementing functions of the chlorine removal, the ionization, the antibacterial performance and the deodorization. As a result, the supplied water may be useful to the user, especially, to a human body.

BRIEF DESCRIPTION OF THE DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

BEST MODE

Reference will now be made in detail to the specific embodiments of the present invention, examples of which are illustrated in the accompanying drawings. Wherever possible, the same reference numbers will be used throughout the drawings to refer to the same or like parts.

Figure 1:
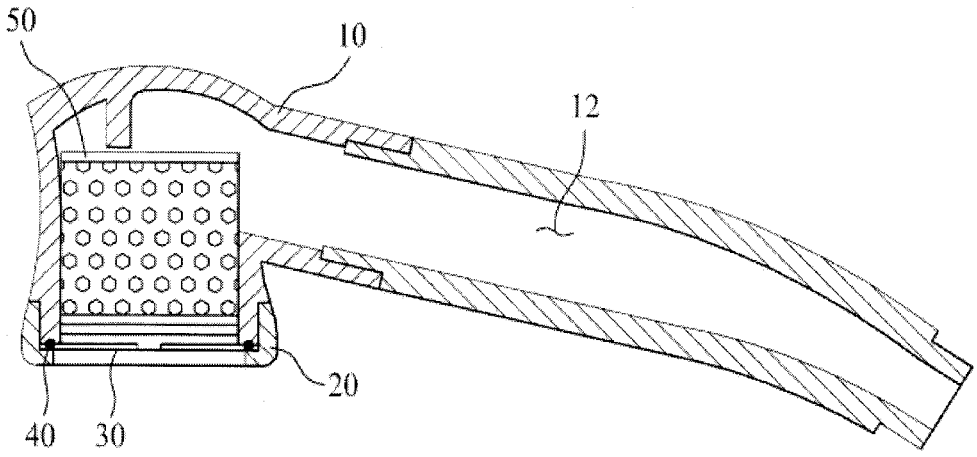
FIG. 1 is a sectional view illustrating a water-saving shower according to an exemplary embodiment of the present invention.
Figure 2:
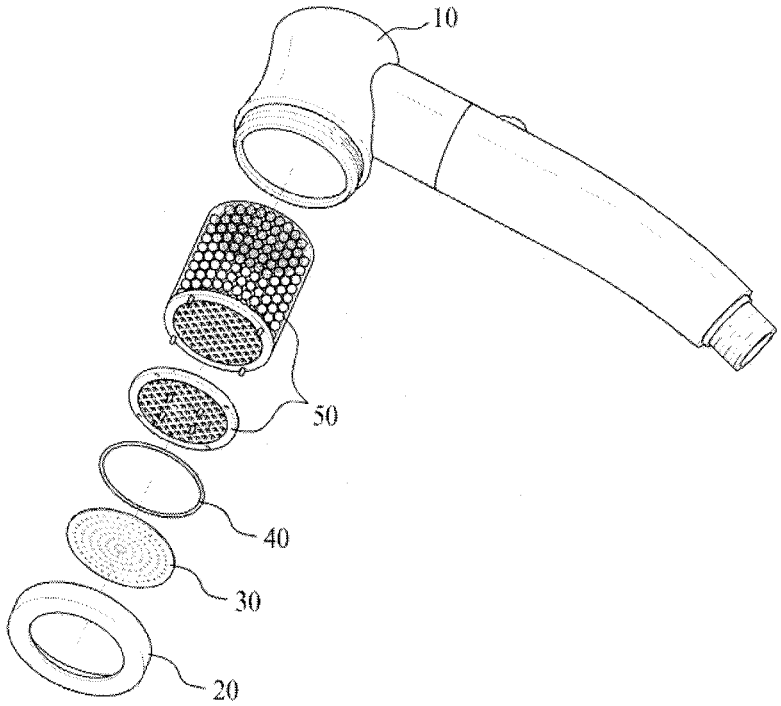
FIG. 2 is an exploded perspective view of FIG. 1.

In reference to FIGS. 1 and 2, an overall configuration of a shower having a shower filter according to an embodiment of the present invention used therein will be described as follows. Here, FIG. 1 is a sectional view illustrating a water-saving shower according to an exemplary embodiment of the present invention. FIG. 2 is an exploded perspective view of FIG. 1.

A shower according to this embodiment includes a head body 10, a filter 50, an O-ring, a shower plate 30 and a head cap 20.

The head body 10 according to this embodiment is presented to be a sitting type as shown in FIGS. 1 and 2 and the present invention is not limited thereto. The head body 10 may be formed of variable types.

An inner path 12 is provided in the head body 10 to guide flow of supplying fluidal material and the fluidal material supplied along the inner path 12 passes the filter 50 and the shower plate 30 provided in the head body 10, to be sprayed to objects.

Here, the O-ring 40 is employed to prevent the supplying fluid from being exhausted from a connected portion between the shower plate 30 and the head body 10, not from a plurality of spray holes 32 and 34 formed in the shower plate 30, when the supplying fluid passes the shower plate 30 to be sprayed to the object.

The filter 50 is provided in the head body 10 to filter foreign substances contained in the supplying fluid supplied via the inner path 12 of the head body 10, located on a rear surface of the shower plate 30. The detailed description of the filter 50 will be made later.

The shower plate 30 having a thin plate shape is provided in the head body 10 and the plurality of the spray holes 32 and 34 may be formed in the shower plate 30 to enable the supplying fluid supplied via the inner path 12 to be sprayed toward the shower object.

After the shower plate 30, the O-ring 40 and the filter 50 are secured in the head body 10, the head cap 30 may be secured to the head body 10 and it protects all of the shower plate 30, the O-ring 40 and the filter 50.

Figure 3:
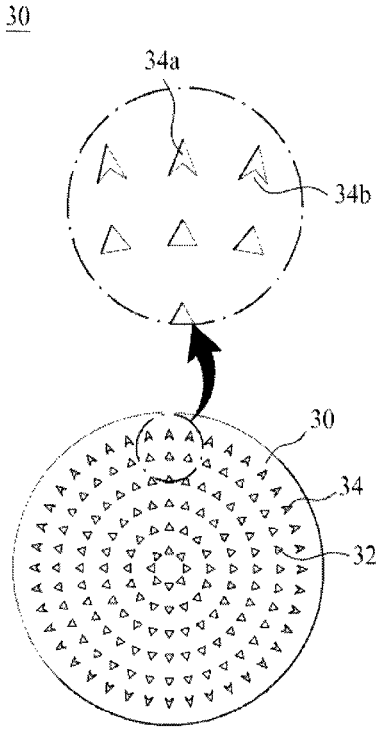
FIG. 3 is an enlarged plane view illustrating a shower plate according to an embodiment of the present invention.
Figure 4:
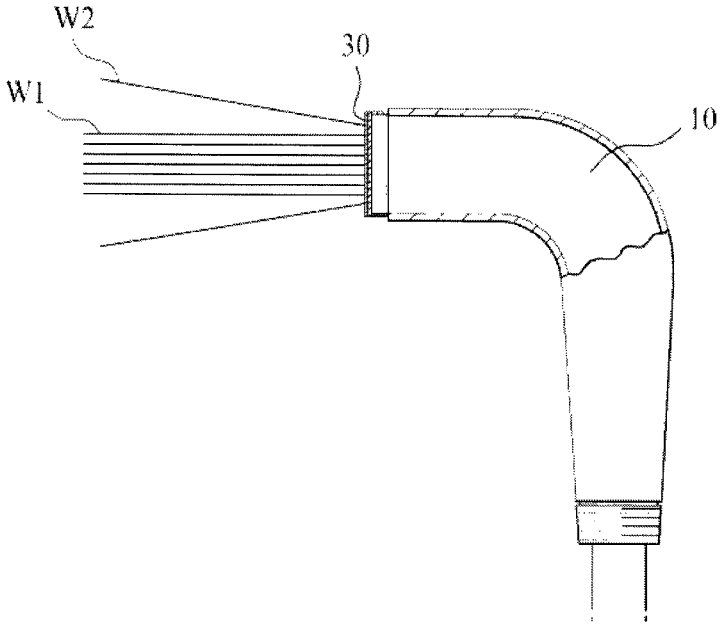
FIG. 4 is a diagram illustrating a shape of water sprayed from a head body having the shower plate shown in FIG. 3 inserted therein.
Figure 5:
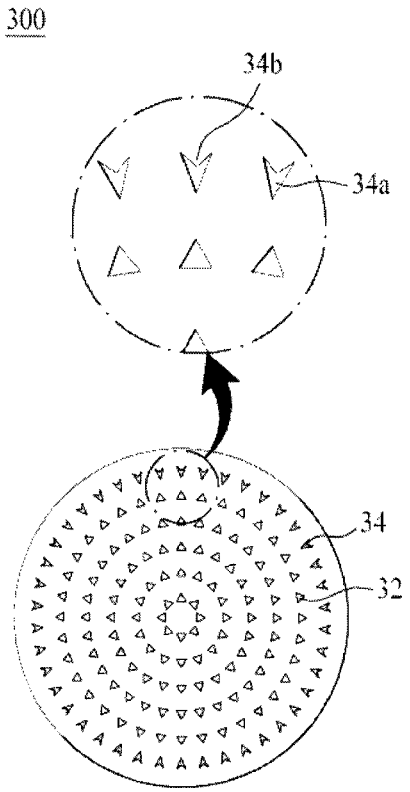
FIG. 5 is an enlarged plane view illustrating a shower plate according to another embodiment.
Figure 6:
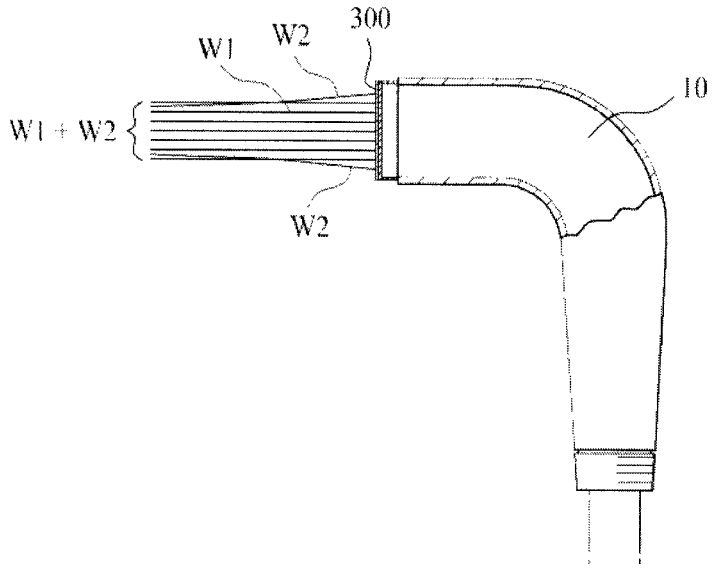
FIG. 6 is a diagram illustrating a shape of water sprayed from a head body having the shower plate shown in FIG. 5 inserted therein.
Figure 7:
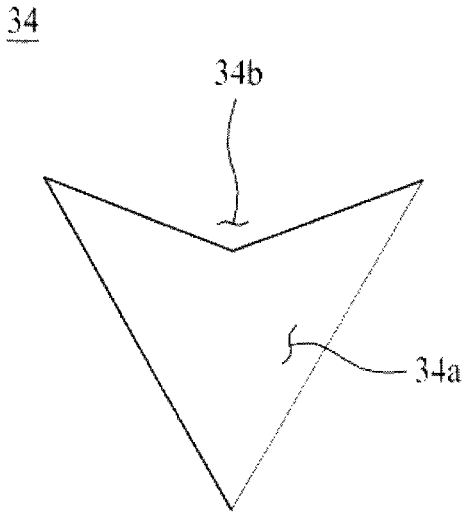
FIG. 7 is an enlarged view illustrating a direction changing spray hole shown in FIG. 2.

Next, in reference to FIGS. 3 to 7, a process of the supplying fluid being sprayed from the head body 10 having the shower plate 30 according to the embodiment secured therein will be described as follows. Here, FIG. 3 is an enlarged plane view illustrating a shower plate according to an embodiment of the present invention. FIG. 4 is a diagram illustrating a shape of water sprayed from a head body having the shower plate shown in FIG. 3 inserted therein. FIG. 5 is an enlarged plane view illustrating a shower plate according to another embodiment. FIG. 6 is a diagram illustrating a shape of water sprayed from a head body having the shower plate shown in FIG. 5 inserted therein. FIG. 7 is an enlarged view illustrating a direction changing spray hole shown in FIG. 2.

The thin-plate-shaped shower plate 30 is provided to supply the supplying fluid via the inner path 12 and the plurality of the spray holes 32 may be formed in the shower plate 30 to spray the supplying fluid outside. At least one of the spray holes 32 configured of a spray hole part 34*a* and a direction changing part 34*b* projected inwardly may be configured to be a direction changing spray hole 34 and the direction changing spray holes 34 may be located in an edge portion of the shower plate in the shower plate 30.

Here, a spraying scope of the supplying fluid via the direction changing spray holes 34 located in the edge portion of the shower plate 30 may be determined by the inward or outward projection of the direction changing part 34*b* from the shower plate 30.

Once the supplying fluid is supplied to the direction changing spray hole 34, the supplying fluid may be concentrated on an opposite portion of the direction changing part 34*b* and the fluid may be obliquely sprayed in an opposite direction of the direction changing part 34*b* accordingly.

As shown in FIG. 3, the direction changing holes 34 having the direction changing parts 34*b* projected toward an outside of the shower plate 30 may be located in the edge portion of the shower plate 30. The spray holes 32 having no direction changing parts 34*b* formed therein may be located inner to the direction changing spray holes 34. Because of that, the supplying fluid supplied via the shower plate 30 may be diffused broadly.

As shown in FIG. 4, the supplying fluid (W1) sprayed via the spray holes 32 having no direction changing parts 34*b* formed therein may be sprayed in a perpendicular direction of the shower plate 30. The supplying fluid (W2) sprayed via the direction changing spray holes 34 may be sprayed in an oblique direction of the shower plate 30 to be diffused broadly.

In contrast, as shown in FIGS. 5 and 6, to make the supplying fluid (W1 and W2) sprayed via a shower plate 300 sprayed intensively, the direction changing parts 34*b* formed in the direction changing spray holes 34 located in the edge portion of the shower plate 300 may be projected toward the inside of the shower plate 300.

As a result, when the shower plate 300 having the direction changing part 34*b* projected toward the inner portion of the shower plate 300 is secured to the head body 10, the supplying fluid (W1) sprayed via the spray holes 32 having no direction changing parts 34*b* may be sprayed in the perpendicular direction of the shower plate 300. The supplying fluid (W2) sprayed via the direction changing spry holes 34 may be oblique sprayed in an inner direction of the shower plate 300, only to be united with the supplying fluid (W1) sprayed via the spray holes 32 having no direction changing parts to be intensively supplied to a single point.

A shown in FIGS. 3 and 5, the spray hole 34 according to this embodiment is a triangle-shaped and the present invention is not limited thereto. The spray hole 34 may have a variety of shapes, for example, a circular shape and polygonal shape and the like.

The direction changing spray hole 36 may also have a variety of shapes. As shown in FIGS. 3, 5 and 7, the direction changing spray hole 36 may be formed in a concave quadrangle shape according to the shape of the spray hole 34.

Especially, in case the degree of the oblique supply of the supplying fluid, structural stability and production efficiency are experimented, the concave quadrangle shaped direction changing spray hole 36 is the most excellent one.

Figure 8:
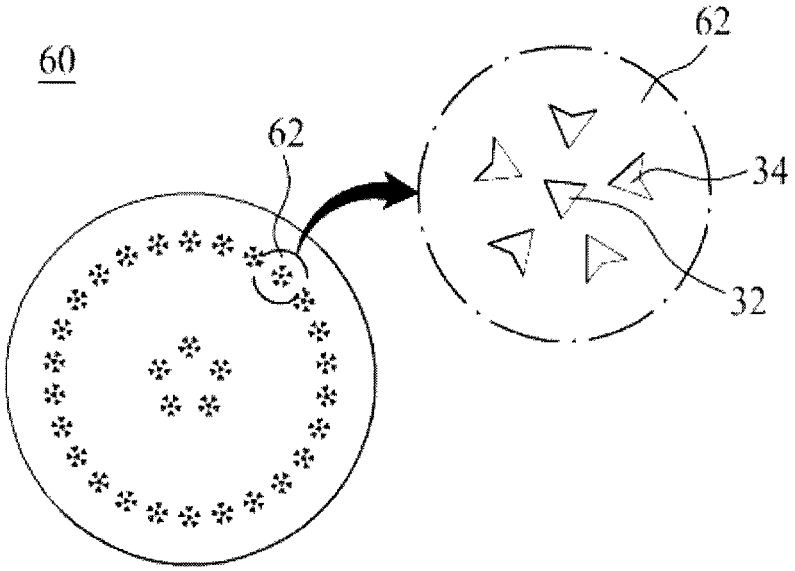
FIG. 8 is an enlarged plane view illustrating a shower plate according to a further embodiment.
Figure 9:
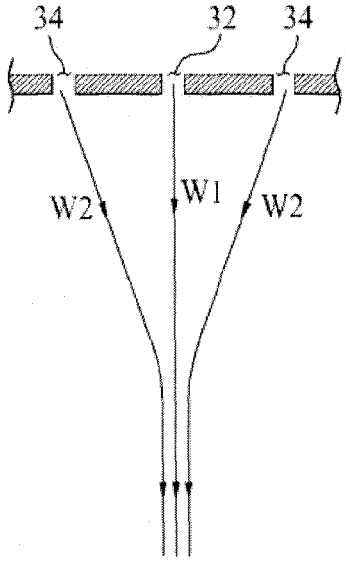
FIG. 9 is a diagram illustrating a process of water streams united into a single stream because of the shower plate shown in FIG. 8.

As follows, a shower plate 60 according to a further embodiment of the present invention will be described in reference to FIGS. 8 and 9. Here, FIG. 8 is an enlarged plane view illustrating a shower plate according to a further embodiment. FIG. 9 is a diagram illustrating a process of water streams united into a single stream because of the shower plate shown in FIG. 8.

The shower plate 60 according to this embodiment includes a plurality of shower spray groups arranged therein. The shower spray group is formed of a plurality of direction changing spray holes 34 to unite the sprayed fluid into a single stream.

Here, the direction changing spray holes 34 may be arranged toward a center of the shower spray groups to unite the supplying fluid sprayed via the shower spray groups 62 in a direction of a normal of the center of the shower spray groups 62.

The plurality of the shower spray groups 62 having the plurality homes formed therein may be arranged in the shower plate 60 according to this embodiment. As shown in FIG. 8, the shower spray groups 62 are arranged in a two-concentric circle shape and the arrangement of the shower spray groups 62 may be variable depending on cases.

At least one spray hole 32 is formed in a center of each shower spray group 62 and the direction changing spray holes 34 are arranged surroundingly adjacent to the spray hole 32.

The direction changing spray holes 34 are arranged with the spray hole as their center in each of the shower spray groups 62. Because of that, when the supplying fluid is sprayed via the shower spray groups 62, the supplying fluid (W2) obliquely sprayed toward the spray hole 32 via the direction changing spray holes 34 may be united with the supplying fluid (W1) sprayed via the spray hole 32, only to form a single stream.

The supplying fluid (W1 and W2) sprayed out via the shower spray groups 62 may be united into a single stream. As a result, diameters of the spray hole 32 and the direction changing spray hole 34 may be relatively small. Although the absolute quantity of the supplying fluid substantially sprayed to the user is decreased, the user cannot feel any change of the quantity of the supplying fluid advantageously.

As shown in FIG. 9, the direction changing parts 34*b* of the direction changing spray holes 34 may be projected toward the center of the shower spray groups 62 to obliquely spray the supplying fluid (W2) sprayed via the direction changing spray holes 34 toward the supplying fluid (W1) sprayed via the spray holes 32.

The shower plate 60 is configured of the plurality of the shower spray groups 62 as mentioned above and the supply fluid sprayed via the shower spray groups 62 is united into a single stream. Because of that, the diameters of the spray hole 32 and the direction changing spray hole 34 may be smaller.

As a result, in case of a home shower, for example, the diameters of the spray holes 32 and the direction changing spray holes 34 which are formed in the shower plate 60 may be relatively small. Because of Lenard Effect in that the amount negative ions contained in the air when the water is sprayed via the spray holes 32 and the direction changing spray holes 34 is increased, the amount of the negative-ion generation may be increased.

According to this embodiment mentioned above, the spray hole 32 is triangle-shaped and the direction changing spray hole 34 is concave-quadrangle-shaped. Because of that, when water passes the spray hole 32 and the direction changing spray hole 34, negative-ions contained in the air may be effectively increased, in comparison to a circular-shaped spray hole formed in the conventional shower plate.

A single stream (W1) is formed through the spray hole 32 located in the center of the shower spray groups 62 and the stream (W2) sprayed via the direction changing spray holes 34 around the spray hole 32 is obliquely sprayed toward the center of the shower spray groups 62 to be united with the stream (W1) formed via the spray hole 32 into a single stream.

Figure 10:
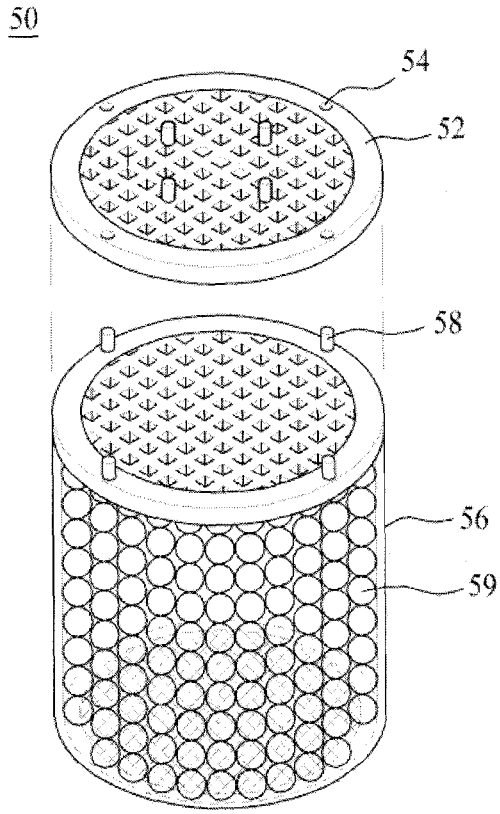
FIG. 10 is an exploded perspective view illustrating a filter shown in FIG. 2.
Figure 11:
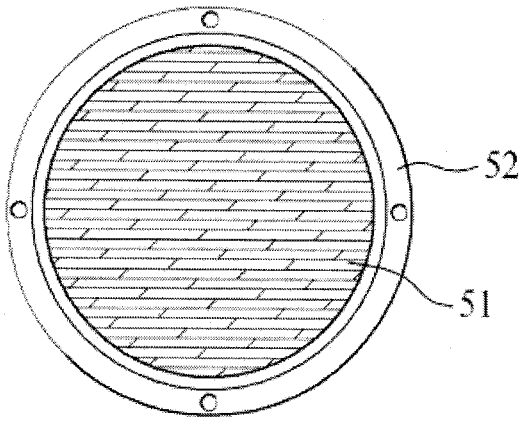
FIG. 11 is a diagram illustrating a state of a filtering net shown in FIG. 10 being placed on a filtering net supporter.
Figure 12:
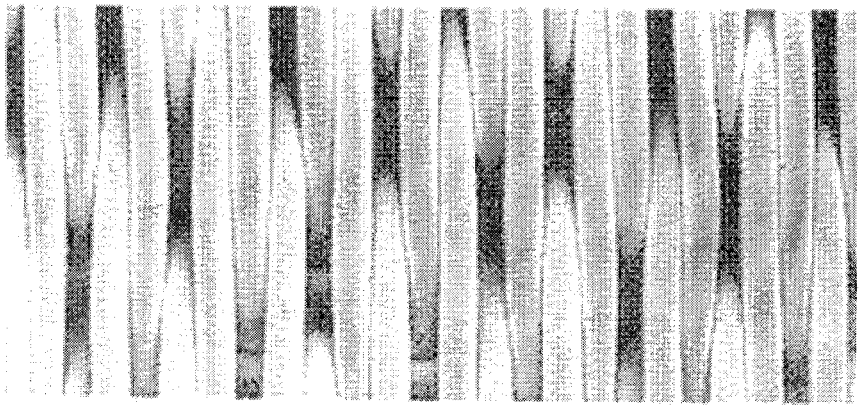
FIG. 12 is an enlarged view illustrating upper and side surfaces of the filtering net textured satin shown in FIG. 10.
Figure 12:
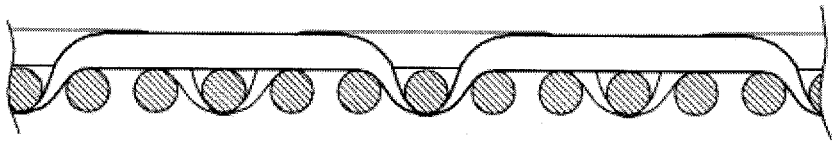

Lastly, the filter 50 of the water-saving shower according to the embodiment of the present invention will be described in reference to FIGS. 10 to 12. FIG. 10 is an exploded perspective view illustrating a filter shown in FIG. 2. FIG. 11 is a diagram illustrating a state of a filtering net shown in FIG. 10 being placed on a filtering net supporter. FIG. 12 is an enlarged view illustrating upper and side surfaces of the filtering net textured satin shown in FIG. 10.

The filter 50 is located in rear of the rear surface of the shower plate 30 within the head body 10 to filter foreign substances contained in the supplying fluid supplied along the inner path 12 of the head body 10 before they reach the shower plate 30.

The filter 50 includes a filtering net supporter 52 and a filtering net 51. The filtering net supporter 52 has a plurality of openings formed therein not to interfere with the flow of the supplying fluid supplied along the inner path 12 of the head body 10. The filtering net 51 textured with synthetic fabric is coupled to a rear surface of the filtering net supporter 52 and it filters the foreign substances contained in the supplying fluid.

As mentioned above, the filtering net 51 may be woven with Polypropylene (PP) fabric and it may be woven with a variety of synthetic fabrics.

As shown in FIG. 10, the filter according to this embodiment includes a filter housing 56 and the filter housing 56 is filled with ceramic balls 59 capable of implementing functions of chlorine removal, ionization, antibacterial performance, deodorization and the like contained in the supplying fluid, especially, water supplied to the home shower.

The filter housing 56 has a plurality of openings formed in front and rear surfaces to pass the supplying fluid, not interfering with the flow of the supplying fluid.

The supplying fluid drawn along the inner path 12 of the head body 10 passes the openings formed in the rear surface of the filter housing 56 and the ceramic balls 59 capable of implementing functions of the chlorine removal, the ionization, the antibacterial performance and the deodorization. As a result, useful supplying fluid may be supplied to the user.

The ceramic balls 59 filled in the filter housing 56 may be made of red clay and they may be made of one of sulfur balls, tourmaline gemstone, selenium, negative-ion resin, germanium, red clay, elvan, zeolite and sericite or compounds thereof.

The filter housing 56 is coupled to the filter net supporter 52 and the filtering net 51 according to this embodiment is satin-woven with synthetic fabric, for example, Polypropylene (PP). The filtering net 51 may be flexible smoothly and it is securely supported by the filtering net supporter 52 to be prevented from deformity and damage which might be caused by the water pressure.

To secure the filtering net supporter 52 and the filtering housing 56 to each other, securing holes 54 are formed in the filtering next supporter 52 and securing fins 58 projected from the filtering housing 56 are integrally formed with the filtering housing, to correspond with the securing holes 54 of the filtering net supporter 52.

As mentioned above, the filtering net 51 woven with synthetic fabric, for example, PP is secured to the rear surface of the filtering net supporter 52.

Only an outer end of the filtering net 51 is heat-stakingly secured to the filtering net supporter 52. As a result, the flow of the supplying fluid may not be interfered with and the deformity and damage of the filtering net 51 caused by the water pressure may be prevented.

The filtering net 51 may be woven with synthetic fabric, for example, PP and this embodiment presents the filtering net 51 is satin-woven. However, the filtering net 51 may be woven in various types.

Since it is satin-woven, the filtering net 51 may be densely formed enough to filter the foreign substances contained in the supplying fluid efficiently.

The foreign substances contained in the supplying fluid drawn along the inner path 12 of the head body 10 are filtered by the filtering net 51 and they will be loaded in the filtering net 51 too much to interfere with the flow of the supplying fluid. In this case, the filtering net 51 can be washed to reuse, without replaced with a new one.

Moreover, since the filtering net 51 is satin-woven, a surface of the filtering net 51 may be smooth and this enables the filtering net 51 to be washed more conveniently.

The shower including the shower plate 30 and the filter mentioned above may be applicable to business use and industrial washing lines, rather than home use.

In case the shower is a home shower, the supplying fluid supplied to the shower according to the present invention may be water and the present invention is not limited thereto. The supplying fluid may be variable according to usage of showers.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A shower plate provided in a shower head used to supply fluid along an inner path thereof, the shower plate comprising:

a plurality of spray hole groups, each spray hole group comprising a spray hole and a plurality of direction changing spray holes arranged to circle the spray hole, the spray hole and each direction changing spray hole configured to spray the supplying fluid out, wherein the spray hole having a triangle shape is located in a center of each spray hole group, wherein each direction changing spray hole has a concave-quadrangle shape, the concave-quadrangle shape defining a spray hole part and a direction changing part, the direction changing part projecting toward an inward of each direction changing spray hole, a width of the direction changing part becoming narrower toward the inward of each direction changing spray hole, wherein each direction changing spray hole is formed to penetrate the shower plate from a rear surface of the shower plate to a front surface of the shower plate in a thickness direction of the shower plate which is substantially perpendicular to the front and rear surfaces of the shower plate and is spaced apart from a circumferential surface of the shower plate, wherein the direction changing part is extended along the thickness direction from the rear surface of the shower plate to the front surface of the shower plate to have a length substantially the same as a length of each direction changing spray hole.

2. The shower plate as claimed in claim 1, wherein the direction changing spray holes are located in an outer portion of the shower plate and a spraying scope of the supplying fluid is determined by outward or inward projection of the direction changing parts with respect to the shower plate.

3. The shower plate as claimed in claim 1, wherein the plurality of spray hole groups are arranged in the shower plate to unite the supplying fluid sprayed out into a single stream.

4. The shower plate as claimed in claim 1, wherein the direction changing part is projected toward the at least one spray hole formed in the center of each spray hole group.

* * * * *